United States Patent [19]

Narushima

[11] 4,425,047

[45] Jan. 10, 1984

[54] PRINTING MACHINE CAPABLE OF PRINTING CHARACTERS ON LONG AND SHORT PAPER SHEETS

[75] Inventor: Tsugio Narushima, Mishima, Japan

[73] Assignee: Tokyo Electric Co., Ltd., Tokyo, Japan

[21] Appl. No.: 297,822

[22] Filed: Aug. 31, 1981

[30] Foreign Application Priority Data

Sep. 11, 1980 [JP] Japan ..... 55-126336
Sep. 11, 1980 [JP] Japan ..... 55-126337
Sep. 11, 1980 [JP] Japan ..... 55-126338

[51] Int. Cl.[3] ..... B41J 11/48

[52] U.S. Cl. ..... 400/605; 400/124; 400/320; 400/328; 400/636; 400/641; 400/645; 400/656; 400/608

[58] Field of Search ..... 400/55, 56, 57, 59, 400/124, 328, 535, 599, 600, 600.1, 600.2, 600.3, 603, 605, 607.2, 608, 608.1, 636, 636.3, 641, 642, 643, 662, 585.1, 320

[56] References Cited

U.S. PATENT DOCUMENTS

| | | | |
|---|---|---|---|
| 924,460 | 6/1909 | Hess | 400/636.3 |
| 1,085,900 | 2/1914 | Freeman | 400/600.2 X |
| 1,131,997 | 3/1915 | Cooper | 400/585.1 X |
| 1,140,190 | 5/1915 | Secor | 400/608 X |
| 1,372,568 | 3/1921 | Smith | 400/608.1 |
| 1,433,718 | 10/1922 | Harris | 400/608.1 |
| 1,515,213 | 11/1924 | Keene | 400/608.1 X |
| 1,655,957 | 1/1928 | Hokanson | 400/535 |
| 1,931,514 | 10/1933 | Smith | 400/608 X |
| 3,850,355 | 11/1974 | Downie et al. | 400/641 X |
| 3,995,730 | 12/1976 | Kwan et al. | 400/636 X |
| 4,024,940 | 5/1977 | Hendrischk et al. | 400/56 |
| 4,062,436 | 12/1977 | Kondur, Jr. et al. | 400/124 |
| 4,173,420 | 11/1979 | Okabe | 400/608.1 X |
| 4,215,945 | 8/1980 | Habich et al. | 400/636 |

FOREIGN PATENT DOCUMENTS

| | | | |
|---|---|---|---|
| 8378 | 3/1980 | European Pat. Off. | 400/636 |
| 682151 | 10/1939 | Fed. Rep. of Germany . | |

*Primary Examiner*—Ernest T. Wright, Jr.
*Attorney, Agent, or Firm*—Frishauf, Holtz, Goodman and Woodward

[57] ABSTRACT

A printing machine capable of printing characters on two kinds of paper sheets, long paper sheets and short paper sheets, comprises two paper holder members movably provided relative to a paper feed roller to cause the long paper sheet to be clamped between the paper holder members and the paper feed roller, and a drive mechanism for moving the paper holder members to clamp a long paper sheet between the paper holder members and the paper feed roller when a pinch roller is pivoted away from the paper feed roller by another drive mechanism in order to set a short paper sheet into a space between a platen and a printing head.

10 Claims, 15 Drawing Figures

29B
29C
48A
29A
48A
46A
29B
8
46B
50C
49
45
48
50
51
50B
48B
47
50A
52
45
29
44A
25
50D
44
29D
44B
9
11B
6B
7
11A
6A
54
53
53A
4A
2
1A
6
4B
28
4C
27
5
3B
3A
3C
1
20
21
35A
10
34
5A
36
24
19
23
37
38
22A
23D
16
16A
12
35B
39
22
15
26
23
13
14
35
23D
18
40
43
41
X
42
17A
17

PRINTING MACHINE CAPABLE OF PRINTING CHARACTERS ON LONG AND SHORT PAPER SHEETS

BACKGROUND OF THE INVENTION

This invention relates to a printing machine for printing characters on paper sheets, and more particularly to a printing machine which is capable of selectively or simultaneously printing characters on two kinds of paper sheets.

A printing machine of this type is loaded with a long paper sheet such as journal paper and a short paper sheet such as slips. The long paper sheet is continuously supplied and is cut at an arbitrary position after a necessary amount of printing has been completed. Therefore, the length of the cut paper sheet is variable. The long paper sheet is clamped between a pinch roller and a paper feed roller in the printing machine and this long paper sheet is then fed by rotation of the paper feed roller.

On the other hand, short paper sheets of a predetermined length are loaded as need arises. After the long paper sheet is loaded, the pinch roller is separated from the paper feed roller to form a predetermined gap between the rollers. Then the short paper sheet is inserted through the gap between the pinch roller and the paper feed roller into the printing machine.

Thus, in the conventional printing machine of this type, the long paper sheet is released from its clamped condition between the pinch roller and the paper feed roller simultaneously with the loading operation of the short paper sheet. Consequently, this free long paper sheet is readily displaced. When this paper sheet is again clamped by the pinch and paper feed rollers, it may be held in an improper position or in an inclined condition, which has been one of the defects of such a conventional printing machine.

SUMMARY OF THE INVENTION

In view of the situation described above, it is an object of this invention to provide a printing machine which can maintain one kind of paper sheet in its proper position without causing displacement thereof, even when another kind of paper sheet is added for selectively or simultaneously printing characters on both kinds of paper sheets; and which can realize excellent printing results.

According to an aspect of the present invention, there is provided a printing machine which comprises a printing portion for printing characters on a long paper sheet and/or a short paper sheet; a paper feed roller which has a stationary axis and is pivotal about the stationary axis; a pinch roller which is disposed parallel to the paper feed roller, has a movable axis and is pivotal about the movable axis; a first drive mechanism for moving the pinch roller along one direction so as to clamp the long paper sheet and/or the short paper sheet between the pinch roller and the paper feed roller, and for moving it along the other direction so as to release this clamped condition; and a second drive mechanism for rotating the paper feed roller so as to feed the long paper sheet and/or the short paper sheet clamped between the paper feed roller and the pinch roller toward the printing portion, the improvement which comprises a paper holder member movable relative to the paper feed roller to cause a long paper sheet to be clamped between the paper holder member and the paper feed roller, and a third drive mechanism for moving the paper holder member so as to clamp the long paper sheet between the paper holder member and the paper feed roller when the pinch roller is moved from the paper feed roller along the other direction by the first drive mechanism in order to set a short paper sheet into the printing portion.

DETAILED DESCRIPTION OF THE PREFERRED EMBODIMENT

Figure 1:
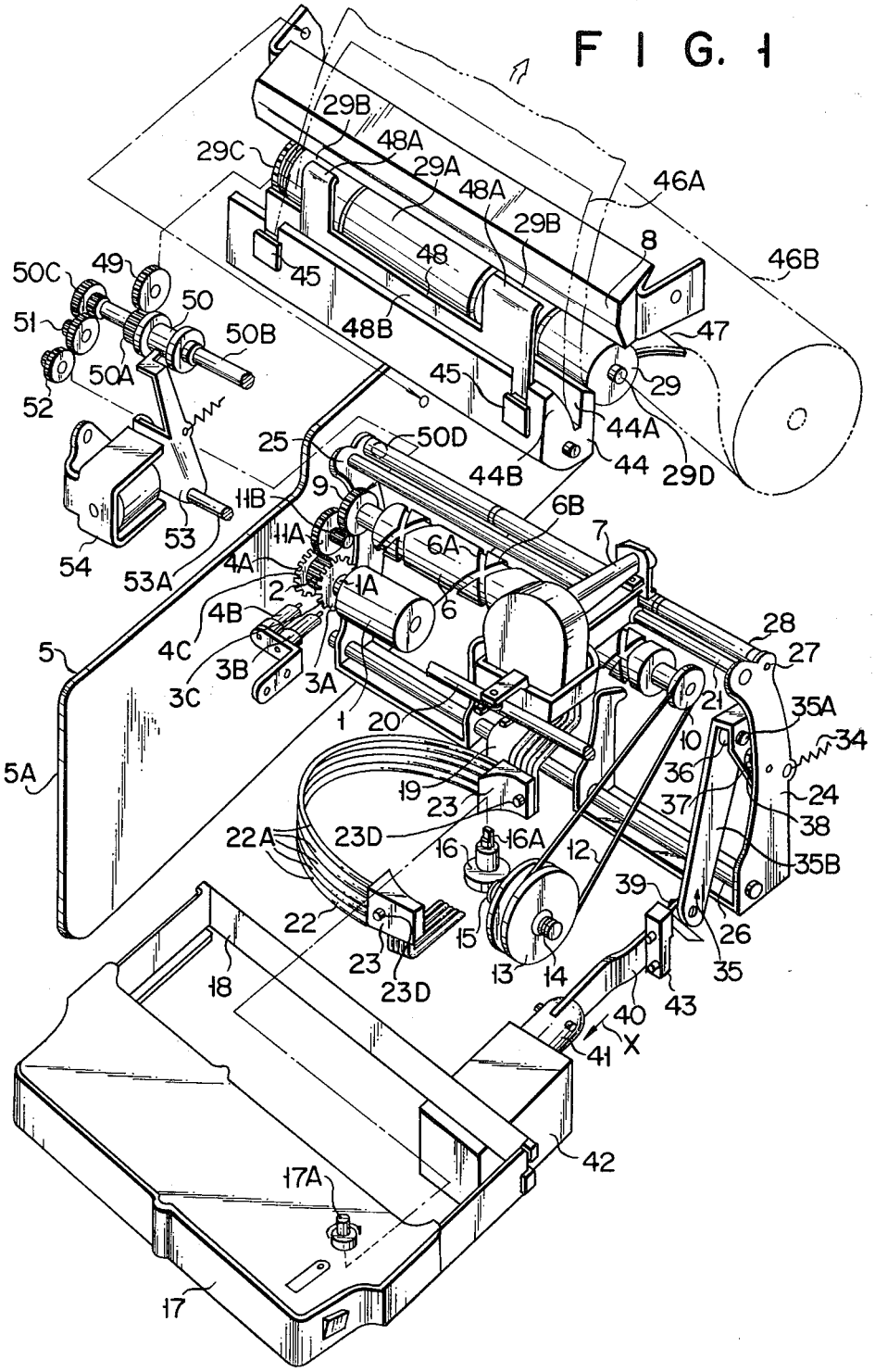
FIG. 1 is an exploded perspective view showing one embodiment of a printing machine according to the present invention.

Referring to FIG. 1, a printing machine of the wire dot type which prints characters on a long rolled paper sheet and/or a short paper sheet has a body frame 5. A motor 1 having a rotation shaft 1A is fixed in the body frame 5. To one end of the rotation shaft 1A of this motor 1, a motor gear 2 and a pair of detecting discs 3A and 4A are fixed coaxially to each other, with the motor gear 2 being held between the pair of detecting discs 3A and 4A. Around the entire circumferential edge of one detecting disc 3A, many recesses 3C are formed, the number of which is larger than that of the number of recesses 4C formed around the entire circumferential edge of the other detecting disc 4A. These recesses 3C,4C are evenly distributed on the respective detecting discs 3A,4A. A pair of detectors 3B and 4B are respectively arranged in the body frame 5 near the respective detecting discs 3A and 4A. Each of the detectors 3B and 4B detects the number of recesses 3C,4C of the respective detecting discs 3A and 4A which have passed by it, and output pulse signals corresponding to this number. Therefore, with the rotation of the rotation shaft 1A of the motor 1, one detector 3B outputs pulse signals with a period time shorter than that of the other detector 4B. The pulse signals from each detector 3B and 4B are utilized as character pulses for dot printing, so that the output pulse signals from one of the detectors 3B and 4B are selectively used, depending upon the size of a character to be printed.

A driving shaft 6 is rotatably arranged in the body frame 5 at a predetermined distance from and parallel to the rotation shaft 1A of the motor 1. This driving shaft 6 is adapted to move and drive a printing head 7 of the wire dot type, to be described in detail later, parallel to a platen 8 fixed to the body frame 5. In the outer circumferential surface of the driving shaft 6 are cut two spiral cam grooves 6A and 6B extending in opposite directions to each other, these cam grooves 6A,6B bisecting each other but being connected to each other at both ends. A driving gear 9 at one end of this driving shaft 6 and a driving pulley 10 at the other end of driving shaft 6 are fixed to be coaxial. The driving gear 9 intermeshes with the motor gear 2 via a set of a larger intermediate gear 11A and a smaller intermediate gear 11B which are coaxially fixed to each other. Thus, the rotation of the rotation shaft 1A of the motor 1 is reduced in speed and then transmitted to the driving shaft 6.

A ribbon feed pulley 13 is rotatably arranged in the body frame 5 near said other end of the driving shaft 6. An endless belt 12 is stretched over the driving pulley 10 and the ribbon feed pulley 13. The rotational force of the driving pulley 10 is transmitted via the endless belt 12 to the ribbon feed pulley 13. The ribbon feed pulley 13 is provided with a friction transmitting mechanism. According to this embodiment, the friction transmitting mechanism comprises a spring 14, which is designed such that, under a predetermined condition, it does not transmit the rotational force of the ribbon feed pulley 13 to the other parts. A ratchet gear 15 is coaxially connected to the ribbon feed pulley 13 via this friction transmitting mechanism. This ratchet gear 15 intermeshes with a ribbon feed gear 16, with their respective rotation axes orthogonally intersecting.

The ribbon feed gear 16 has a shaft portion 16A which is coaxial therewith. The shaft portion 16A is engageable with a ribbon take-up shaft 17A provided in an ink ribbon cassette 17. The ink ribbon cassette 17 is removably attached to the body frame 5 and accommodates an ink ribbon 18, a part of which is exposed to the outside. The ink ribbon cassette 17 is attached to the body frame 5 in such a manner that the ribbon take-up shaft 17A engages with the shaft portion 16A and the ink ribbon 18 is disposed between the printing head 7 and the platen 8. Therefore, the ink ribbon 18 is taken up by the take-up shaft 17A and moves gradually with the rotation of the take-up shaft 17A. When the ink ribbon 18 has been used up to the end, the friction transmitting mechanism slips even if the ribbon feed pulley 13 is rotated for feeding the ink ribbon 18. Thus, the transmission of rotational force from the ribbon feed pulley 13 to the ratchet gear 15 is interrupted. Likewise, when the ribbon take-up shaft 17A is manually rotated and driven in order to eliminate the slack in the ink ribbon 18, the ratchet gear 15 also idles relative to the ribbon feed pulley 13 through the friction transmitting mechanism.

The above-mentioned printing head 7 is attached to a movable carrier 19. The carrier 19 is slidably supported by two round guide rods 20 and 21 disposed parallel to the platen 8. Consequently, the carrier 19 can be shifted parallel to the platen 8. On this carrier 19 is rotatably mounted a cam roller (not shown but similar to cam 92 in U.S. Pat. No. 4,062,436) which is fitted in one of the pair of cam grooves 6A and 6B of the driving shaft 6. Therefore, when the driving shaft 6 is rotated in one direction by the motor 1, the carrier 19 simultaneously reciprocates rectilinearly through the engagement between the cam roller (not shown) and the grooves 6A and 6B, while maintaining the parallel relationship to the platen 8.

The printing head 7 is not shown in detail, but comprises a plurality of dot wires arranged in a longitudinal line, and magnetic plungers and coils provided in correspondence with the respective dot wires to allow them to selectively project toward the platen 8, all similar to the print head shown in U.S. Pat. No. 4,062,436. The coil of each magnetic plunger receives control signals through a flat cable 22 formed by joining a plurality of lead wires 22A. This flat cable 22 is fixed to the carrier 19 and the body frame 5, respectively, via a pair of fixtures 23. The flat cable 22 between the fixtures 23 is loose enough to permit the movement of the carrier 19.

Figure 2:
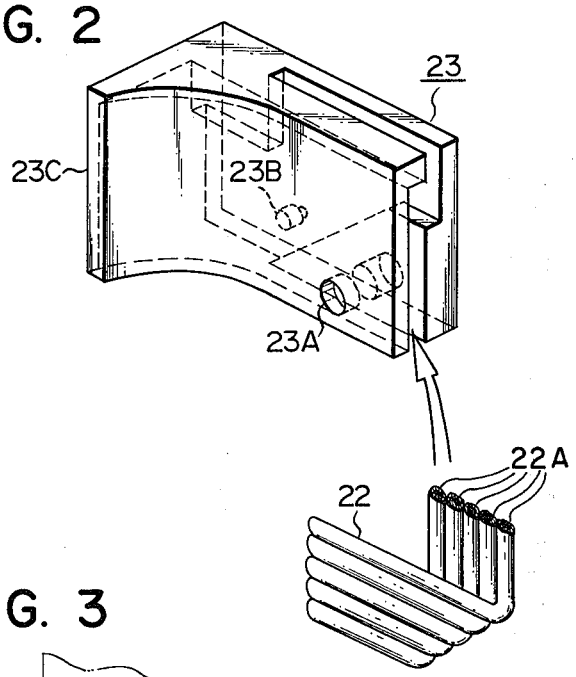
FIG. 2 is a perspective view of a fixture used for the printing machine shown in FIG. 1.

Each fixture 23 is integrally molded from a synthetic resin and has an internal space so that it may hold the flat cable 22 folded at almost a right angle in one plane, as shown isolated in FIG. 2. These fixtures 23 are fixed to the carrier 19 and to the body frame 5 by inserting fitting screws 23D (FIG. 1) into through holes 23A which are formed through the fixtures 23 in the direction of the thickness thereof. Projections 23B are provided on the respective surfaces of the fixtures 23 facing the carrier 19 or the body frame 5. The projections 23B engage portions of the carrier 19 or the body frame 5 which oppose these projections 23B to prevent rotation of the fixtures 23 due to rotation of the fitting screws 23D (FIG. 1) during installation.

The shape of the internal space of the fixture 23 is properly adapted to that of the angled edge portion of the flat cable 22 folded as described above. Consequently, the flat cable 22 does not move easily in the fixture 23, and also is not cut due to repeated deformation in the fixture 23. In addition, one end portion 23C of the internal space of each fixture 23 is outwardly flared. Therefore, that portion of the flat cable 22 which is guided from the internal space through this one end portion 23C to the outside is only moderately deformed in accordance with the shift of the carrier 19, and is not cut there.

Figure 3:
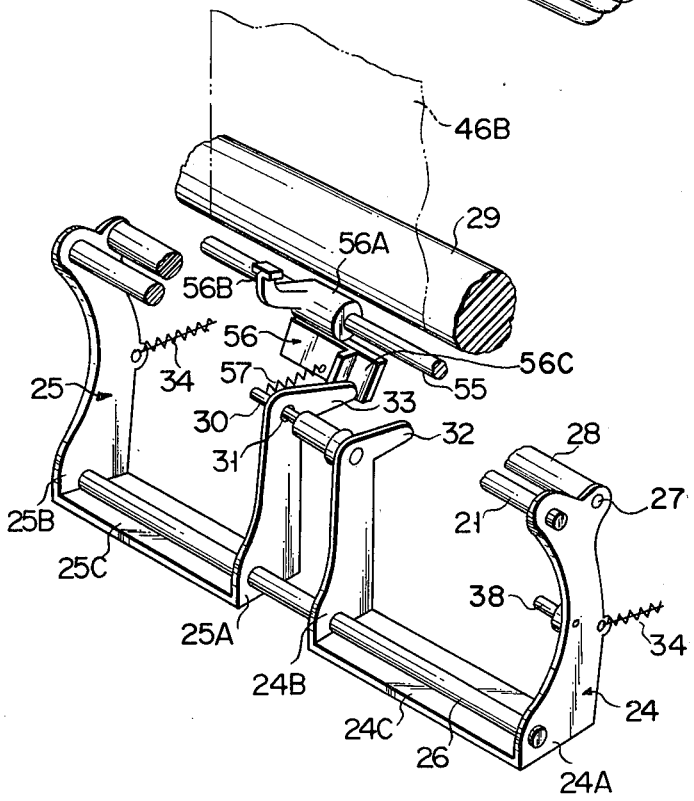
FIG. 3 is a perspective view of a movable support and a paper holder member shown in FIG. 1.

As shown again in FIG. 1, of the pair of guide rods 20 and 21 described above, one guide rod 20 for supporting the rear end of the carrier 19 is fixed at both ends thereof to the side walls 5A (only one shown in FIG. 1) of the body frame 5. The other guide rod 21 supporting the front end of the carrier 19 is supported between a pair of movable supports 24 and 25 (which together comprise a movable support means, each of which is bent in an approximate U-shape. Both movable supports 24 and 25 are pivotally supported on a common support shaft 26. This common support shaft 26 is disposed parallel to the platen 8 and is fixed at both ends to the side walls 5A of the body frame 5. As best seen in FIG. 3, each movable support 24 and 25 comprises two upstanding elements 24A and 24B or 25A and 25B and a connecting element 24C or 25C for connecting the lower ends of the respective upstanding elements 24A, 24B and 25A, 25B to each other. The support shaft 26 extends through the lower portions of the upstanding elements 24A, 24B, 25A and 25B of the two movable supports 24 and 25. The outer upstanding element 24A and 25B stand higher than the inner upstanding element 24B and 25A, respectively. The ends of the other guide rod 21 are fixed to the upper rear end portions of the respective outer upstanding elements 24A and 25B of the movable supports 24 and 25. A pinch roller supporting shaft 27 is fixed at both ends parallel to the platen 8 at the upper front end portions of the outer upstanding elements 24A and 25B of the movable supports 24 and 25. On the outer circumference of this pinch roller supporting shaft 27 is coaxially and rotatably supported a pinch roller 28. This pinch roller 28 is made of soft synthetic rubber. The pinch roller 28 is brought in or out of contact with a paper feed roller 29 to be described in detail later, which is disposed below and parallel to the platen 8, according to the pivotal movement of both movable supports 24 and 25 about their support shaft 26.

Figure 8:
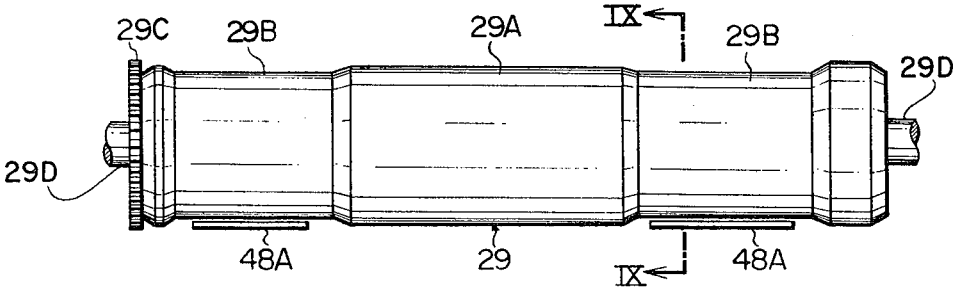
FIG. 8 is a plan view of a paper feed roller shown in FIG. 1.
Figure 10:
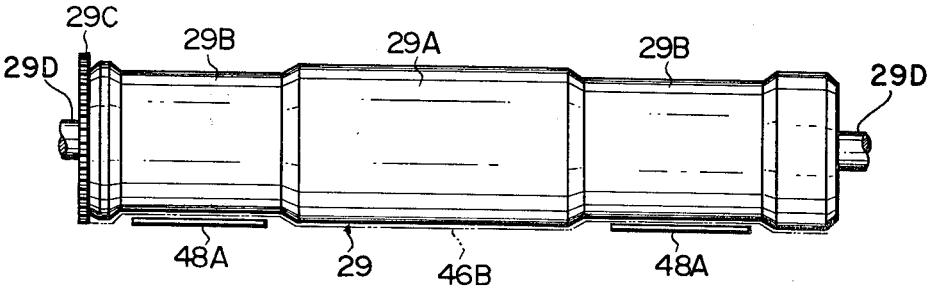
FIG. 10 is a plan view showing the contact condition between the paper feed roller and a long paper sheet.

As shown in FIGS. 8 and 10, the paper feed roller 29 is mounted with its axis stationary by means of shaft 29D (about which it is rotatable), and comprises an enlarged diameter portion 29A situated in the middle, and reduced diameter portions 29B at both sides of the enlarged diameter portion 29A, the enlarged and reduced diameter portions 29A and 29B being coaxial with each other. The paper feed roller 29 is made of soft synthetic rubber. A driven gear 29C is fixed coaxially to one end of the paper feed roller 29; that is, on the same side as the side where the driving gear 9 is provided on the driving shaft 6. This paper feed roller 29 clamps the paper sheet 46A and/or 46B (not shown in FIG. 8) between itself and the pinch roller 28, and feeds the paper sheet 46A and/or 46B upwardly with the rotation of the paper feed roller 29.

As shown in FIG. 3, an engaging pin 30 is provided at the inner upstanding element 24B of the movable support 24 so as to project toward the other movable support 25. The inner upstanding element 25A of the movable support 25 is formed with a through hole 31 for receiving the front end of the engaging pin 30. The diameter of this through hole 31 is determined such that it is slightly larger than the diameter of the distal end section of the engaging pin 30. Consequently, both movable supports 24 and 25 can pivot independently of each other relative to the support shaft 26, but the range of this independent pivotal movement is limited to the range of play of the engaging pin 30 in the through hole 31. When the limit of this range is reached, in other words, when the engaging pin 30 abuts against the circumferential edge of the through hole 31, both supports 24 and 25 rotate as a unit. With such a construction, dimensional errors in the movable supports 24 and 25 arising during manufacture may be absorbed, and the pinch roller 28 may contact with uniform pressure the paper feed roller 29 while rotating.

At the upper front end portions of the inner upstanding elements 24B and 25A of the movable supports 24 and 25 are provided with abutting portions 32 and 33 which project toward a position below the paper feed roller 29. Tension springs 34 span the gaps between the body frame 5 and the respective outer upstanding elements 24A and 25B of the movable supports 24 and 25. Each spring 34 constantly urges the movable supports 24 and 25 in the direction wherein the pinch roller 28 pivotally supported by these supports 24 and 25 rotates and contacts the paper feed roller 29. Thus, as shown in FIG. 4, the rotational contact of the pinch roller 28 with the paper feed roller 29 maintains a gap G of constant width between the platen 8 and the printing head 7.

Figure 4:
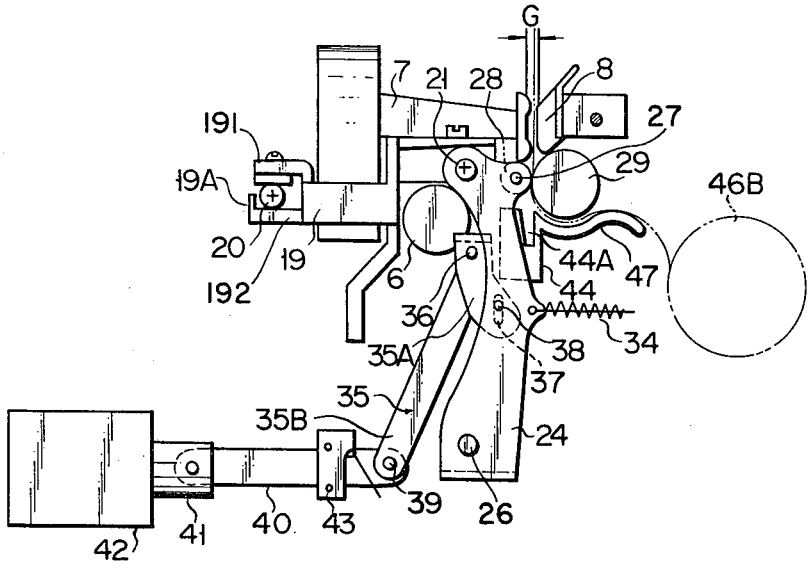
FIG. 4 is a side view schematically showing the supported conditions of a printing head and a pinch roller.

The rear end portion of the carrier 19 described above is supported by the guide rod 20, as shown in FIG. 4. The rear end portion of the carrier 19 forks into two forked parts 191, 192 and is supported by clamping one guide rod 20 between these forked parts 191, 192 respectively from above and below. With such a construction, the approaching or separating movement of the pinch roller 28 toward or from the paper feed roller 29, in other words, the approaching or separating movement of the carrier 19 toward or from the platen 8, is never suppressed. Therefore, when the other guide rod 21 is displaced with the pivotal movement of both movable supports 24 and 25, the carrier 19 is displaced together with this guide rod 21 as a unit, whereby the printing head 7 approaches or separates toward or from the platen 8. In addition, one forked part 192 below at the rear end of the carrier 19 is provided at its rear edge with a bent element 19A standing up from this rear edge. The bent element 19A is designed so that it abuts against the guide rod 20 when the carrier 19 is disposed toward the platen 8, thereby preventing further pivotal movement so that the front end of the printing head 7 is not brought into contact with the platen 8.

Figure 5:
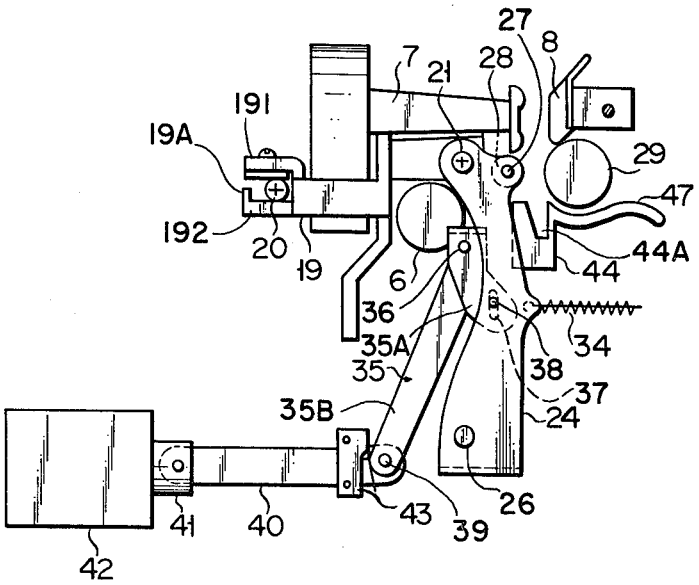
FIG. 5 is a side view showing a different operating condition from that shown in FIG. 4.

As shown in FIGS. 1 and 4, a transmission lever 35 is pivotally attached behind the outer upstanding element 24A of the movable support 24 to the body frame 5 via a pivotal shaft 36. This transmission lever 35 has two arms 34A and 35B integrally formed and extending in two directions from the pivotal shaft 36. An elongate hole 37 extending vertically is formed at the distal end of one arm 35A. An engaging pin 38 provided to project from the outer upstanding element 24A of the movable support 24 is inserted into the elongated hole 37. One end of a connecting rod 40 is pivotally attached to the distal end of the other arm 35B through a connecting pin 39. The other end of this connecting rod 40 is connected to the distal end of a plunger 41. This plunger 41 is arbitrarily moved and driven a predetermined amount by a drive mechanism 42 in the direction of projection from the drive mechanism 42. When the drive mechanism 42 is operated and the plunger 41 is retracted into the drive mechanism 42 in the direction indicated by an arrow X in FIG. 1, the movable supports 24 and 25 pivot counterclockwise about the support shaft 26 against the urging force of the springs 34. As shown in FIG. 5, the pinch roller 28 is separated from the paper feed roller 29 and the movable supports 24 and 25 stop in the position wherein the printing head 7 on the carrier 19 is greatly separated from the platen 8, and are held in this position. The position shown in FIG. 4 is defined as a printing position, and that shown in FIG. 5, as a printing stop position.

The drive mechanism 42 comprises an electro-magnetic drive (not shown in detail) having a plunger 41, such as generally known in the art and shown in, for example, U.S. Pat. No. 4,062,436.

A microswitch 43 is disposed beside the connecting rod 40 near the connecting pin 39. When the plunger 41 is retracted in the direction indicated by the arrow X in FIG. 1, the microswitch 43 is turned on by the transmission lever 35. Being turned on, the microswitch 43 permits indication of the positions of the movable supports 24 and 25, i.e., the position of the printing head 7. In other words, it is indicated by the microswitch 43 whether the printing head 7 is in the printing position or in the printing stop position.

As shown in FIG. 1, a paper stopper 44 having a longitudinal axis parallel to the platen 8 is disposed below the region between the paper feed roller 29 and the pinch roller 28, and is fixed to the body frame 5. On the upper surface of this paper stopper 44 is formed a paper receiving groove 44A which extends along the longitudinal direction. The paper receiving groove 44A is provided to receive a predetermined length of a short paper sheet 46A, such as a slip, and to hold it in a predetermined position. On either side of the paper receiving groove 44A are mounted paper sensors 45. These paper sensors 45 discriminate whether the short paper sheet 46A is in the paper receiving groove 44A or not. The short paper sheet 46A is inserted from above through the gap G between the platen 8 and the printing head 7, and then through the broadened space between the paper feed roller 29 and the pinch roller 28, into the paper receiving groove 44A of the paper stopper 44.

Figure 6:
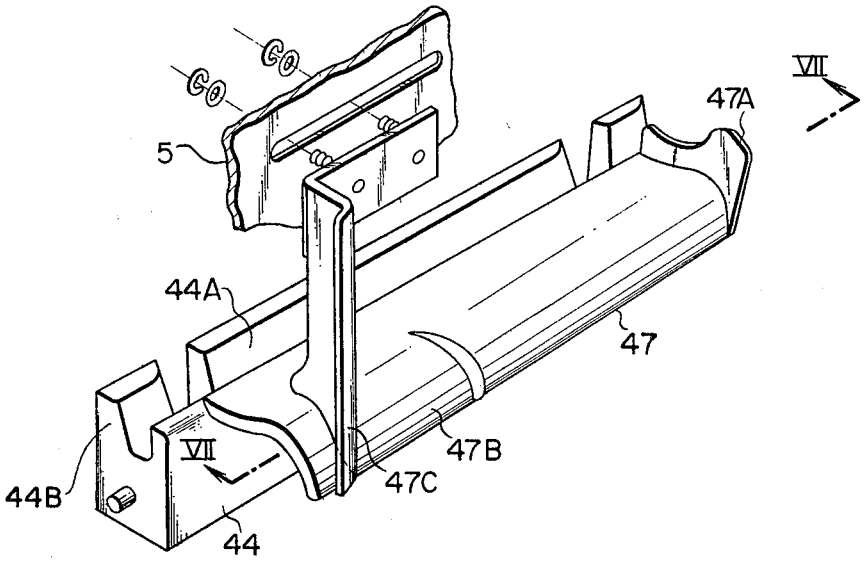
FIG. 6 is a perspective view of a paper guide shown in FIG. 1.
Figure 7:
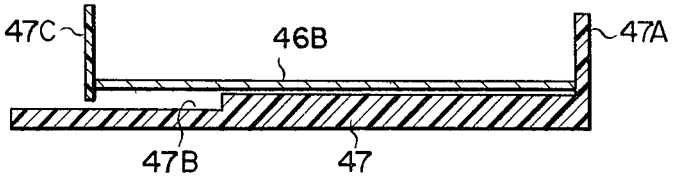
FIG. 7 is a sectional view along the line VII—VII of the paper guide shown in FIG. 6.

As is shown in FIG. 6, a paper guide 47 extending along the longitudinal axis of the paper stopper 44 is connected to the rear edge of the paper stopper 44. This paper guide 47 is disposed below the paper feed roller 29 and at a proper distance from the lower portion thereof. Behind the paper guide 47, a roll of long paper sheet 46B such as journal paper is pivotally and removably attached to the body frame 5. This roll of long paper sheet 46B lies parallel to the longitudinal axis of the paper feed roller 29. The leading edge of the long paper sheet 46B is guided along the upper surface of the paper guide 47, passing between the paper guide 47 and the bottom of the paper feed roller 29 and then taken up upwardly. As shown in FIG. 6, one end of the paper guide 47 is integrally provided with a stationary side wall 47A standing upwardly therefrom for guiding one side edge of the long paper sheet 46B. Additionally, a recessed flank portion 47B is provided on the upper surface at the other side of the paper guide 47, and a paper width adjustor 47C for guiding the other side edge of the long paper sheet 46B is provided just above the flank portion 47B at the other end side of the paper guide 47, the paper width adjustor 47C being movable along the longitudinal direction of the paper guide 47. This paper width adjustor 47C is movably attached to the body frame 5 and is shifted in position to correspond to the width of the long paper sheet 46B used. Therefore, the long paper sheet 46B is precisely guided at both side edges by the stationary side wall 47A and the paper width adjustor 47C, whereby the long paper sheet 46B is prevented from being displaced in the direction of its width. As shown in FIG. 7, since the lower end of the paper width adjustor 47C is situated within the flank portion 47B, the other side edge of the long paper sheet 46B never protrudes outside through the gap between the adjustor 47C and the paper guide 47. Thus, it is ensured that the long paper sheet 46B is prevented from being shifted in the direction of the paper width.

Figure 9:
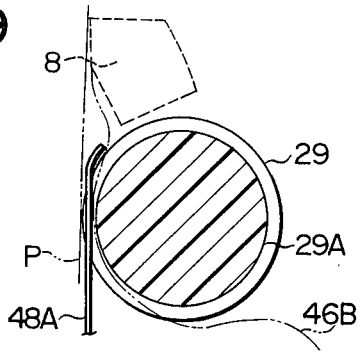
FIG. 9 is a sectional view along the line IX—IX of the paper feed roller shown in FIG. 8.

As shown in FIG. 1, a guide plate 48 formed by a leaf spring is mounted on the rear wall 44B of the paper receiving groove 44A of the paper stopper 44. The base end portion 48B (i.e., the lower portion) of the guide plate 48 is fixed to the rear wall 44B. The right and left end portions of the upper end of the guide plate 48 are provided with a pair of holding portions 48A which project upwardly from the paper receiving groove 44A. Each holding portion 48A is respectively located on each reduced diameter portion 29B of the paper feed roller 29, and the holding portions 48A always lightly press against the surfaces of the reduced diameter portions 29B, as shown in FIGS. 8 and 9. The difference in radius between the reduced diameter portions 29B and the enlarged diameter portion 29A of the paper feed roller 29 is set to be larger than the thickness of the holding portions 48A of the guide plate 48. Consequently, the distal ends of the holding portions 48A do not protrude beyond a virtual plane P which is tangent both to the surface of the platen 8 and to the outer circumferential surface of the enlarged diameter portion 29A of the paper feed roller 29. In other words, the presence of this guide plate 48 will not prevent the short paper sheet 46A and/or the long paper sheet 46B from being clamped between the paper feed roller 29 and the pinch roller 28.

After having passed between the bottoom of the paper feed roller 29 and the paper guide 47, the long paper sheet 46B is guided upwardly along the surface of the guide plate 48 which faces the paper feed roller 29, passes between the pinch roller 28 and the paper feed roller 29, and is further guided upward. At this point, the portion of the long paper sheet 46B lying between the pinch roller 28 and the paper feed roller 29 is brought into close contact with the outer circumferential surface of the paper feed roller 29 by the holding portions 48A of the guide plate 48, as shown in FIG. 10. Therefore, when the pinch roller 28 is separated from the paper feed roller 29, a space is surely kept between the long paper sheet 46B and the pinch roller 28. On the other hand, the short paper sheet 46A inserted downwardly between the paper feed roller 29 and the pinch roller 28 is guided to the other surface of the guide plate 48 to abut against the bottom of the paper receiving groove 44A in the paper stopper 44. In this manner, the position of the short paper sheet 46A at which the printing is to be started is defined.

As shown again in FIG. 1, an intermediate gear 49 intermeshes with the driven gear 29C fixed at one end of the paper feed roller 29. This intermediate gear 49 also intermeshes with a clutch gear 50A of a spring clutch mechanism 50. The spring clutch mechanism 50 has a clutch shaft 50B disposed parallel to the platen 8 and pivotally attached to the body frame 5 through hole 50D in body frame 5. The clutch gear 50A is coaxially mounted on the clutch shaft 50B. To one end of the clutch shaft 50B is coaxially fixed an actuating gear 50C. Other intermediate gears 51 and 52 intermesh with actuating gear 50C. These other intermediate gears 51 and 52 also intermesh with the driving gear 9 fixed at one end of the driving shaft 6. On the other hand, the spring clutch mechanism 50 is provided with a clutch lever 53 for controlling the rotational force transmission of the spring mechanism 50. The clutch lever 53 is pivotally supported on and about a shaft 53A mounted parallel to the platen 8 to project from the body frame 5. One end of this clutch lever 53 is disengageable from the spring clutch mechanism 50. When this one end engages with the spring clutch mechanism 50, the spring clutch mechanism 50 does not transmit power, but when this one end is separated from the spring clutch mechanism 50, the spring clutch mechanism 50 can transmit power. An electromagnet 54 is provided at the other end of the clutch lever 53 close thereto. When it is de-energized, the electromagnet 54 does not attract the other end of the clutch lever 53, and the one end of the clutch lever 53 engages with the clutch mechanism 50. On the other hand, when it is energized, the electromagnet 54 attracts the end of the clutch lever 53, and the one end of the clutch lever 53 is separated from the clutch mechanism 50.

Figure 11:
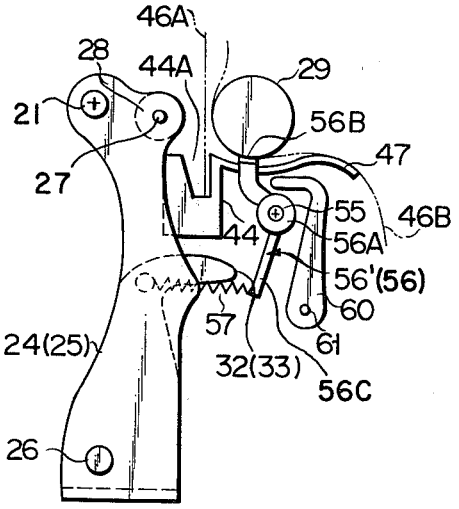
FIG. 11 is a side view schematically showing the relationship between the paper feed roller and the paper holder member.
Figure 12:
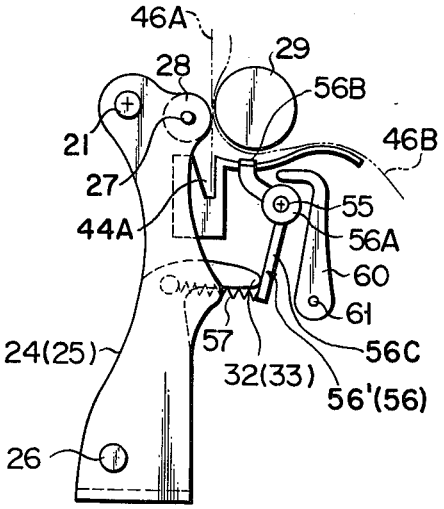
FIG. 12 is a side view showing a different operating condition from that shown in FIG. 11.

As illustrated in FIGS. 3, 11 and 12, a shaft 55 is disposed just below and parallel to the paper feed roller 29 and is fixed to the body frame 5. A pair of paper holder members 56, 56' (FIGS. 11 and 12) are pivotally supported on this shaft 55. However, only one paper holder member 56 is shown in FIG. 3. Each of the paper holder members 56 comprises a cylindrical body 56A; a holding arm 56B extending outwardly from the body 56A along a direction perpendicular to the shaft 55 and having at its end an abutting surface which can abut against the outer circumferential surface of the paper feed roller 29; and an abutting plate 56C which extends outwardly from the body 56A along a direction perpendicular to the holding arm 56B and against which the abutting portions 32 and 33 of the respective movable supports 24 and 25 can abut. For each of the paper holder members 56, a tension spring 57 spans the distance between the respective abutting plates 56C and the engaging pin 30. The respective tension springs 57 bias the respective abutting plates 56C such that these plates 56C always abut against the ends of the respective abutting portions 32 and 33.

In order to further insert the short paper sheet 46A when the long paper 46B has been already set in a predetermined position as shown in FIG. 11, both movable supports 24 and 25 are rotated about the support shaft 26 in the counterclockwise direction in the drawing, amd the pinch roller 28 is separated from the paper feed roller 29. With this pivotal movement, the abutting portions 32 and 33 are also rotated counterclockwise in the drawing and, through the springs 57, the paper holder members 56 rotate clockwise in the drawing about the shaft 55. This pivotal movement of the paper holder members 56 cause the abutting surfaces of the holding arms 56B to abut against the outer circumferential surface of the paper feed roller 29. On the other hand, in order to start printing on the short paper sheet 46A and/or the long paper sheet 46B from the state shown in FIG. 11, both movable supports 24 and 25 are rotated clockwise in the drawing and the pinch roller 28 approaches the paper feed roller 29. The short paper sheet 46A and/or long paper sheet 46B is thus clamped between the pinch roller 28 and the paper feed roller 29. As a result, the short paper sheet 46A and/or the long paper sheet 46B is fed upwardly with the rotation of the paper feed roller 29.

Figure 13:
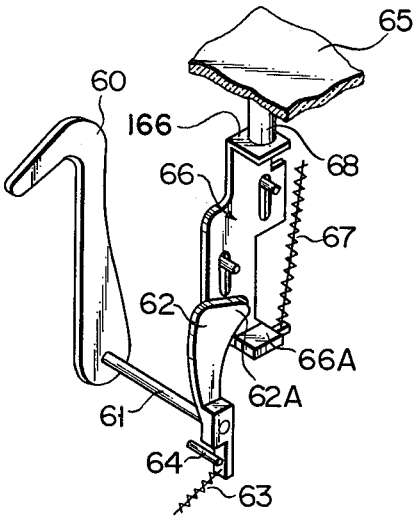
FIG. 13 is a perspective view of a drive mechanism for a release lever shown in FIG. 12.

As shown in FIG. 11, a release arm 60 for forcibly releasing the paper holder members 56 from abutment with the paper feed roller 29 is disposed below the paper guide 47. One end of this release arm 60 extends between the paper guide 47 and the shaft 55 near the holding arms 56B of the paper holder members 56 so that it can be engaged with these holding arms 56B. The other end of the release arm 60 is fixed to one end of a shaft 61 pivotally supported on the body frame 5. One end of a free lever 62 is fixed to a part of this shaft 61, as shown in FIG. 13. The free lever 62 is urged clockwise in this drawing by a spring 63, and the abutment of one end of the free lever 62 to a stopper 64 hinders further pivotal movement. The other end of the free lever 62 is formed with a cam portion 62A having an inclined cam surface. In the stopped position of the free lever 62 shown in FIG. 13, the release arm 60 is situated as shown in FIG. 11 and one end of the release arm 60 is not engaged with the holding arms 56B.

Although the long paper sheet 46B is not illustrated in detail, it may be covered with a cover 65 (partially shown in FIG. 13). This cover 65 is opened for changing the long paper sheet 46B or for setting the long paper sheet 46B to a state wherein the printing is possible.

Figure 14:
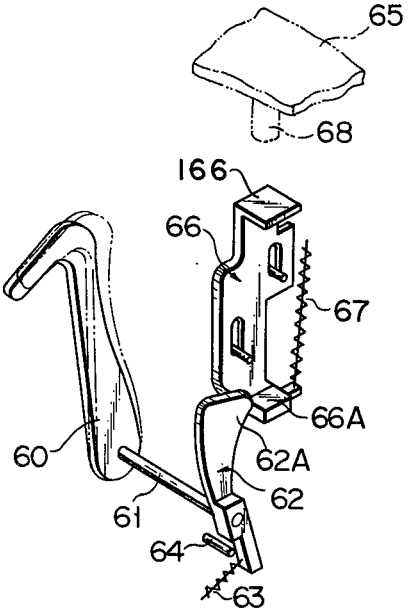
FIG. 14 is a perspective view showing a different operating condition from that shown in FIG. 13.
Figure 15:
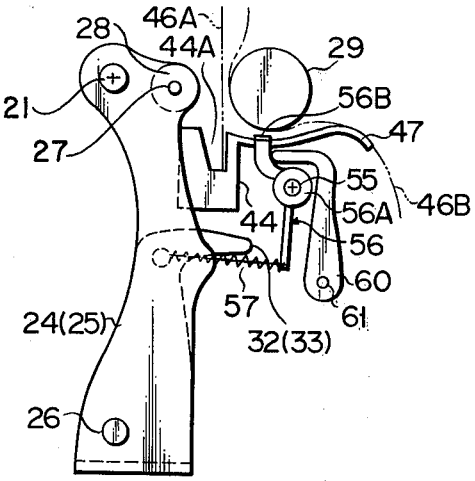
FIG. 15 is a side view showing a different operating condition from that shown in FIG. 13.

An engaging plate 66 which is vertically movable is provided close to the cam portion 62A provided at the other end of the free lever 62. On the lower end of this engaging plate 66 is provided an engaging portion 66A which is in a bent form and can abut against the cam portion 62A. In the state shown in FIG. 13, the cam portion 62A does not abut against the engaging portion 66A. A spring 67 spans the distance between the engaging plate 66 and the body frame 5. This spring 67 always urges the engaging plate 66 upward. On the lower surface of the cover 65 opposite to the upper end 166 of the engaging plate 66, a projection 68 is formed to project downwardly to be capable of abutting against this upper end 166. In the state shown in FIG. 13 wherein the cover 65 is closed, the projection 68 causes the engaging plate 66 to be deflected against the urging force of the spring 67. Therefore, the cam portion 62A of the free lever 62 is not engaged with the engaging portion 66A of the engaging plate 66. However, since the projection 68 is displaced in the state shown in FIG. 14 wherein the cover 65 is opened, the engaging plate 66 is deflected upwardly under the urging force of the spring 67 and thus the engaging portion 66A engages with the cam portion 62A. Therefore, the free lever 62 is pivoted counterclockwise in the drawing about the shaft 61 against the urging force of the spring 63. That is, as shown in FIG. 15, the paper holder members 56 are forcibly released by the release arm 60 from the state wherein they press the long paper 46B against the paper feed roller 29 when the cover 65 is opened, even if the pinch roller 28 and the paper feed roller 29 are separated from each other. In this manner, the long paper sheet 46B may be readily set in a position at which printing is to be started without being obstructed by the paper holder members 56.

The operation of the printing machine of the structure described above will now be described.

While the printing is stopped, the coil of the drive mechanism 42 is not energized and the plunger 41 is attracted by the permanent magnet of the drive mechanism 42. That is, both movable supports 24 and 25 are held at the printing stop positions as shown in FIGS. 5 and 11. In this condition, the platen 8 and the printing head 7 are separated by a distance larger than the gap G, and the pinch roller 28 is also separated from the paper feed roller 20. Consequently, the short paper sheet 46A can be easily inserted up to the paper stopper 44 through the gaps mentioned above. At this point, since the guide plate 48 is pressed against the paper feed roller 29, the short paper sheet 46A will never be accidentally inserted therebetween and can be inserted into the groove 44A of the paper stopper 44 from above or either side in FIG. 1.

The long paper sheet 46B has been already set at a predetermined printing position. Thus, even if the pinch roller 28 is separated from the paper feed roller 29, the long paper sheet 46B is pressed against the paper feed roller 29 by the paper holder members 56 simultaneously with this separation. Therefore, even if the long paper sheet 46B is released from the clamped state by the pinch roller 28 and the paper feed roller 29 and is placed in a free state, the long paper sheet 46B, which is separately held by the paper holder members 56, does not slack and maintains its position. In other words, even when the pinch roller 28 and the paper feed roller 29 are separated from each other in order to subsequently insert the short paper sheet 46A and the long paper sheet 46B is therefore no longer clamped by the pinch and paper feed rollers 28, 29, the long paper sheet 46B maintains the initially set position for starting printing. Excellent printed results may thus be realized without producing shear on the paper sheet 46B.

On the other hand, when the long paper sheet 46B is to be set, the pinch roller 28 and the paper feed roller 29 are separated from each other, while the cover 65 is manually opened. With the separation of the pinch roller 28 from the paper feed roller 29, the paper holder members 56 are made to abut against the paper feed roller 29. However, the paper holder members 56 are separated from the paper feed roller 29 via the released lever 60 simultaneously with the opening of the cover 65. Consequently, as shown in FIG. 15, the long paper sheet 46B passes, without any trouble, between the paper guide 47 and the paper feed roller 29, between the pinch roller 28 and the paper feed roller 29, and between the printing head 7 and the platen 8 sequentially, and is finally set to the printing start position. When the cover 65 is closed under this condition, the long paper sheet 46B is clamped by the paper holder members 56 and the paper feed roller 29.

When printing is to be started with the short paper sheet 46A and the long paper sheet 46B being set in its respective predetermined position for starting printing, the coil of the drive mechanism 42 is energized for a short time so as to produce a magnetic field in the opposite direction to that of the intrinsic magnetic field of the permanent magnet. Then, the overall attractive force of the permanent magnet against the plunger 41 is attenuated, and both movable supports 24 and 25 are rotated under the urging force of the springs 34 to their printing positions as shown in FIGS. 4 and 12, respectively. As a consequence, the short paper sheet 46A and the long paper sheet 46B is clamped by the pinch roller 28 and the paper feed roller 29. The printing head 7 approaches the platen 8. At this time, the gap between the printing head 7 and the short paper sheet 46A and the long paper sheet 46B on the platen 8 always coincides with the gap G between the printing head 7 and the platen 8 established when the paper sheet 46A, 46B is not clamped as described above. This is because the thickness of the short paper sheet 46A and the long paper sheet 46B is combined with the abutting state between the pinch roller 28 and the paper feed roller 29 defining the gap G. In this condition, driving the motor 1 will rotate the driving shaft 6 in one direction, and the carrier 19 will drive the printing head 7 to enable predetermined printing, while maintaining the parallel relationship to the platen 8 through the engagement of one cam groove 6A of the driving shaft 6 with the cam roller of the carrier 19.

While the carrier 19 moves forward in this manner, characters for one line are printed. When the forward movement of the carrier 19 has been completed, the cam roller of the carrier 19 is subsequently engaged in the other cam groove 6B of the driving shaft 6, and at the same time the electromagnet 54 is energized. In this state, the driving shaft 6 still continues to rotate in one direction, so that the carrier 19 starts its backward movement. During this time period, the electromagnet 54 is excited to attract the clutch lever 53. Therefore, the clutch lever 53 is separated from the spring clutch mechanism 50 and the clutch mechanism 50 becomes capable of transmitting power. The rotational driving force of the driving shaft 6 is transmitted to the driven gear 29C of the paper feed roller 29 respectively via the driving gear 9, the intermediate gears 51 and 52, the spring clutch mechanism 50 and the intermediate gear 49. The paper feed roller 29 then rotates clockwise in the drawing by a predetermined angle of rotation. Consequently, the short paper sheet 46A and the long paper sheet 46B clamped between the paper feed roller 29 and the pinch roller 28 is fed upwardly by one line. The respective gear ratios are determined in such a manner that this paper feed operation is terminated at the time of termination of the backward movement of the carrier 19. In this way, when the carrier 19 starts its forward movement again, the characters of the next line are printed on the short paper sheet 46A and the long paper sheet 46B.

The reciprocation of the printing head 7 described above is repeated, and after the predetermined lines of printing have been entirely completed, the printing operation is stopped. When the printing operation stops, the coil of the drive mechanism 42 is energized so as to generate a magnetic field in the same direction as that of the intrinsic magnetic field of the permanent magnet. Then the overall attractive force of the permanent magnet on the plunger 41 is strengthened, and thus the movable supports 24 and 25 are rotated in the direction indicated by the arrow X shown in FIG. 1 against the urging force of the springs 34 and are brought to their stopped positions respectively shown in FIGS. 5 and 11. But the plunger 41 continues to be attracted by the intrinsic magnetic field of the permanent magnet after interruption of power to the coil, so it is maintained in this condition. In such a state, the short paper sheet 46A and the long paper sheet 46B are released from the clamped condition between the pinch roller 28 and the paper feed roller 29. Therefore, the short paper sheet 46A can be readily removed from the printing machine by the operator. In order to remove the long paper sheet 46B, the release arm 60 is rotated in a direction to separate the paper holder members 56 from the paper feed roller 29 against the urging force of the springs 57. In this manner, the long paper sheet 46B is released from its clamped condition between the paper feed roller 29 and the paper holder members 56. As a result, the long paper sheet 46B can be easily removed from the printing machine by the operator and then cut at a required position.

What is claimed is:

1. A printing machine of the type capable of printing characters on two kinds of paper sheets, a long paper sheet and a short paper sheet comprising:

a paper feed roller having a stationary axis and being rotatable about said stationary axis;

a pinch roller having an axis which is movable toward and away from said paper feed roller, said pinch roller being rotatable about the movable axis;

printing means for printing characters on at least one of said long paper sheet and short paper sheet, said printing means including a platen fixed in parallel with said paper feed roller, and a printing head movable toward and away from said platen and in parallel with said platen, said printing head being spaced from said platen;

at least one paper holder member movably provided relative to said paper feed roller and urged to cause said long paper sheet to be clamped between said at least one paper holder member and the paper feed roller;

movable support means for rotatably supporting said pinch roller and for movably supporting said printing head, said movable support means being rotatably arranged about an axis disposed parallel to said pinch roller so that said printing head and said pinch roller are integrally moved relative to said platen and said paper feed roller, said movable support means including an abutting portion engageable with said paper holder member to move said paper holder member away from said paper feed roller, thereby causing said long paper sheet to be unclamped when at least one of said long paper sheet and short paper sheet is clamped between said paper feed roller and said pinch roller, and which is disengageable from said paper holder member to clamp said long paper sheet between said paper feed roller and said paper holder member when said pinch roller is moved away from at least one of said long paper sheet and short paper sheet to release same;

first drive means coupled to said movable support means for selectively moving said movable support means in one direction to clamp at least one of said long paper sheet and short paper sheet between said pinch roller and said paper feed roller and to unclamp said long paper sheet clamped between said paper holder member and said paper feed roller, and for selectively moving said movable support means in another direction to unclamp said at least one of said long paper sheet and short paper sheet clamped between said pinch roller and said paper feed roller and to clamp said long paper sheet between said paper holder member and said paper feed roller; and second drive means coupled to said paper feed roller for rotating said paper feed roller to feed at least one of said long paper sheet and short paper sheet clamped between said paper feed roller and said pinch roller toward a space between said printing head and said platen.

2. The printing machine of claim 1, wherein said pinch roller has two ends; and said movable support means includes two movable supports for supporting both ends of said pinch roller.

3. The printing machine of claim 2, wherein one of said movable supports comprises an engaging pin projecting toward the other of said movable supports; and the other of said movable supports comprises a through hole therein for receiving said engaging pin.

4. The printing machine of claim 3, wheren said through hole has a diameter slightly larger than the diameter of said engaging pin.

5. The printing machine of claim 1, wherein said paper holder member is pivotally mounted; and said first drive means includes an urging member disposed between said paper holder member and said movable support means for urging said paper holder member toward said movable support means so that said paper holder member pivots toward said paper feed roller.

6. The printing machine of claim 5, wherein said abutting portion of said movable support means engages with said paper holder member when said pinch roller and said paper feed roller are rotated in mutual contact or when said paper sheet is clamped therebetween; and said paper holder member is pivoted in the direction to be separated from said paper feed roller against the urging force of said urging member.

7. The printing machine of claim 6, wherein said abutting portion of said movable support means is disengaged from said paper holder member when said pinch roller is pivoted away from said paper feed roller; and said paper holder member is pivoted under the urging force of said urging member to clamp a long paper sheet between said paper holder member and said paper feed roller.

8. The printing machine of claim 1, including means for selectively moving said printing head close to and separated from said platen corresponding to a shift of said pinch roller relative to said paper feed roller.

9. The printing machine of any one of claims 1–8, which further comprises:

a paper stopper having a longitudinal axis parallel to said paper feed roller, said paper stopper being disposed below a region between said paper feed roller and said pinch roller, said paper stopper having a groove therein for receiving a short paper sheet, said groove extending along the longitudinal axis of said paper stopper.

10. The printing machine of claim 9, wherein said paper stopper includes a guide plate having a pair of holding portions which project toward said paper feed roller; and said paper feed roller includes a pair of reduced diameter portions which receive said holding portions, respectively.

* * * * *